United States Patent [19]

Serbu

[11] Patent Number: 4,948,601

[45] Date of Patent: Aug. 14, 1990

[54] DEVICE FOR BREWING COFFEE

[76] Inventor: Gideon P. Serbu, 105 Calverton Cir., Accokeek, Md. 20607

[21] Appl. No.: 419,472

[22] Filed: Oct. 10, 1989

[51] Int. Cl.[5] ..... B65B 29/04; A23F 5/26; B65D 33/14

[52] U.S. Cl. ..... 426/82; 99/323; 206/0.5; 426/77; 426/234; 426/241; 426/433

[58] Field of Search ..... 426/77–84, 426/394, 433, 112, 115, 110, 234, 241; 206/0.5; 99/295, 323

[56] References Cited

U.S. PATENT DOCUMENTS

| | | | |
|---|---|---|---|
| 634,349 | 10/1899 | Humphrey | 426/82 |
| 2,187,417 | 1/1940 | Doble | 426/83 |
| 2,192,605 | 3/1940 | Salfisberg | 426/82 |
| 2,591,606 | 4/1952 | Reed | 426/82 |
| 2,800,408 | 7/1957 | Fimple | 99/295 |
| 2,805,162 | 9/1957 | Kovel | 426/82 |
| 2,879,613 | 3/1959 | DeMario | 426/82 |
| 2,887,037 | 5/1959 | Setecka | 99/295 |
| 3,131,065 | 4/1964 | Salomon | 426/82 |
| 3,215,533 | 11/1965 | Rambold | 206/0.5 |
| 3,657,994 | 4/1972 | Post | 426/82 |
| 3,899,599 | 8/1975 | Rambold | 426/82 |
| 4,141,997 | 2/1979 | Syroka et al. | 426/82 |
| 4,551,336 | 11/1985 | Chen | 426/83 |
| 4,688,479 | 8/1987 | Cunningham | 99/323 |
| 4,715,271 | 12/1987 | Kitagawa | 426/82 |
| 4,726,956 | 2/1988 | Christie | 426/82 |
| 4,756,915 | 7/1988 | Dobry | 426/84 |
| 4,871,555 | 10/1989 | Schwartz | 426/82 |
| 4,875,574 | 10/1989 | Travers | 206/0.5 |

FOREIGN PATENT DOCUMENTS

| | | | |
|---|---|---|---|
| 573897 | 4/1959 | Canada | 426/83 |
| 3704781 | 9/1987 | Fed. Rep. of Germany | 426/83 |
| 2091541 | 8/1982 | United Kingdom | 426/82 |

OTHER PUBLICATIONS

Tea & Coffee Trade J., 1/53, pp. 39, 41, 426/82.

*Primary Examiner*—Steven Weinstein

[57] ABSTRACT

Ground coffee is packaged in a disposable brewing device for use in brewing a mug of coffee in a novel and unique manner facilitated by the use of a microwave oven. To prepare a freshly brewed mug of coffee the disposable device is inserted into and attached unto a coffee mug, water is added and the mug is placed in a microwave oven. A resilient stable element supports and anchors a filter bag containing premeasured amount of ground coffee beans. Expandable inner volume of filter bag facilitates percolation, minimizes buoyant force and prevents spill-over. Materials with varied coefficients of absorption to microwave energy are utilized in construction so that desired temperature differences are realized.

1 Claim, 2 Drawing Sheets

DEVICE FOR BREWING COFFEE

BACKGROUND OF THE INVENTION:

This invention depicts a novel means for brewing a cup of coffee in a filter bag, primarily through the absorption of microwave energy. More particularly this invention pertains to the brewing of a mug of coffee by means of ground coffee beans which are totally enclosed in a filter bag; said bag being held inside a coffee mug which contains a suitable amount of water. The entire ensemble then subsequently to be inserted into a microwave oven wherein through the absorption of microwave energy a rapid and unattended brewing of the coffee beans will take place. Heretofore, many devices have been proposed for brewing coffee in a cup in a manner similar to the brewing of tea by means of a tea bag. Those well versed in the art have applied various novel devices and means in order to facilitate the infusion of hot water through a filter bag containing coffee grounds in order to extract the coffee bean flavor. Rambold in U.S. Pat. No. 3,173,911 issued on Mar. 30, 1965 uses an opening in the handling tag to secure said tag to the coffee pot. William J. Einstman, Warren C. Rehman, and Frank M. Plant in U.S. Pat. No. 3,879,565 issued on Apr. 22, 1975 propose the use of defoaming agents to facilitate immersion of the coffee bag. Edward C. Syroka and Bernice A. Syroka, in U.S. Pat. No. 4,141,997 issued on Feb. 27, 1979 employ a U-shaped resilient clip which is secured on the coffee cup rim. Mark E. Zimmermann in U.S. Pat. No. 4,626,435 issued on Dec. 2, 1986 makes use of a foaming agent to promote agitation and the infusion of water. In prior art the hot water was either added to the container in which the ground coffee bean bag was placed or heat was used to bring the water in the container and the coffee bean bag to a higher temperature in order to facilitate the extraction of the coffee bean flavor in a reasonable period of time. This invention discloses a device which takes into consideration the differential absorption of microwave energy by the water, by the ground coffee beans, by the handling and support element, and by the container; encompassing a device which yields a hot mug of coffee that can be drunk immediately upon removal from the microwave oven due to the fact that the mug containing the coffee does not reach a high temperature whilst the brewed liquid is piping hot.

SUMMARY OF THE INVENTION

A premeasured ground coffee bean amount is contained in a totally enclosed filter bag. The said filter bag being a component part of the disposable brewing device described in this disclosure.

It has been discovered that a flavorful coffee drink may be brewed inside a microwave oven by the means of this disposable brewing device. The disposable brewing device, subsequently to be fully described, is placed inside a coffee mug; then an amount of drinking water is added. The mug is then placed inside a microwave oven where within a short period of time the coffee flavor is extracted. The coffee grounds contained within the filter bag absorb microwaves efficiently as a result water in contact with the coffee grounds begins to boil first, the filter bag begins to inflate due to water vapor and the gases which emanate from the coffee grounds. Inside the mug the water that is outside the filter bag begins to show color indicating that water is flowing in and out of the filter bag. As more microwave energy is absorbed the water in the mug begins to boil and a pleasant aroma of coffee emanates from the microwave oven. When the microwave oven turns off, the filter bag deflates rapidly. The mug may be removed, it's temperature being only slightly warm; then the disposable brewing device may be removed and discarded since the handle of the disposable brewing device is so designed as to absorb very little microwave energy. The length of time needed to brew a mug of coffee is dependent upon the initial water temperature, very short periods may be obtained if one begins the process with very hot water. Using this invention, the above method for brewing is the preferred one; however, sensible heat may be added by means such as a hot plate or a open flame.

Included in the objects of this invention are: To provide a disposable coffee brewing device for individually brewing a single mug of coffee, the coffee grounds being at all times kept submerged in water. To provide a disposable coffee brewing device for brewing a piping hot mug of coffee which may be consumed without discomfort due to a overly heated drinking mug. To provide a disposable coffee brewing device which in addition to having a primary utility inside a microwave oven nonetheless retains function with equal facility by other means of heat infusion. To provide a disposable coffee brewing device which when placed inside a microwave oven brews a tasteful mug of coffee in a short period of time and does so unattended.

BRIEF DESCRIPTION OF THE DRAWINGS

The description of this invention is to be read in conjunction with the following drawings.

DESCRIPTION OF THE PREFERRED EMBODIMENT OF THE INVENTION

Figure 1:
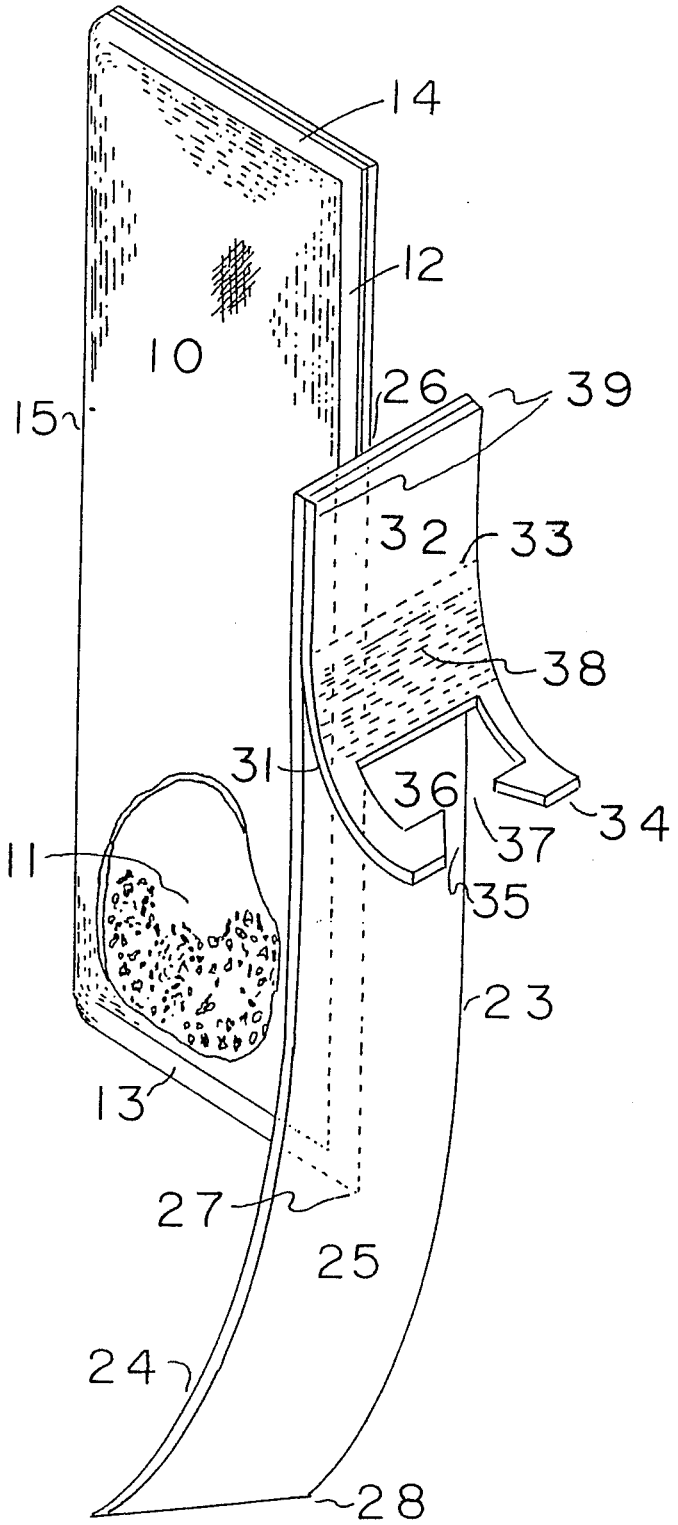
FIG. 1 illustrates a perspective view of the embodiment of a disposable coffee brewing device.

The invention will now be described by referring to a preferred embodiment. In FIG. 1, a bag 10 made out of a filtering material of suitable porosity contains within and completely seals therein a premeasured amount of ground coffee beans 11. The bag is constructed from a rectangular filter material folded along edge 15 and sealed with a continuous seam 14 along the top of bag 10, then extending vertically along 12 and completing the enclosure with the lower seam 13. A portion of the length of the vertical seam 12 is securely attached to a thin elongated rectangular support element 23; attachment is made along approximately three quarters of the length of the vertical edge 12 and the middle region of inner surface 24 of support element 23. The attachment between vertical seam 12 and support element 23 extends continuously from the upper end as at 26 to the lower end as at 27 and so creates in fact a hinge which allows bag 10 to move freely from side to side in respect to surface 24 of support element 23. The unattached upper length along edge 12 of bag 10 extends freely above the hinge terminus support at 26. The thin elongated rectangular element 23 extends for a suitable distance beyond the lower terminus 27 of the hinge which is coincident with the corner formed by edges 12 and 13 of bag 10; the length of extension to the end at 28 of support element 23 will become evident in the subsequent description of FIG. 2. The obtuse surface 25 of support element 23 has attached to it a thin elongated rectangular tab element 30, located at the upper end of support element 23. Surface 31 of tab 30 is in solid attachment to surface 25 of support element 23 in region of common area 32. A separation line occurs at 33 between the support element 23 and the tab element 30. It is evident to those versed in the art that the support element and the tab element can be manufactured as one integral part and serve the same essential functions that are discussed in this disclosure. At the unattached end 34 of tab 30 there is a wedge shaped cut-out as at 35, this cutout connects with a rectangular cutout 36, a narrow passage 37 thus interconnects the two abutting cutout areas. The support element 23 and the tab element 30 are ideally manufactured from a material possessing suitable elastic thermal, and sanitary properties. Support element 23 has a inward bend directed toward the surface 24, whereas tab 30 has a slight outward bend from the separation line 33 toward surface 38 of tab 30. The disposable brewing device illustrated in FIG. 1 may be held with the thumb and forefinger of one hand by grasping along the two edges common to tab 30 and support element 23 and shown at 39.

Figure 2:
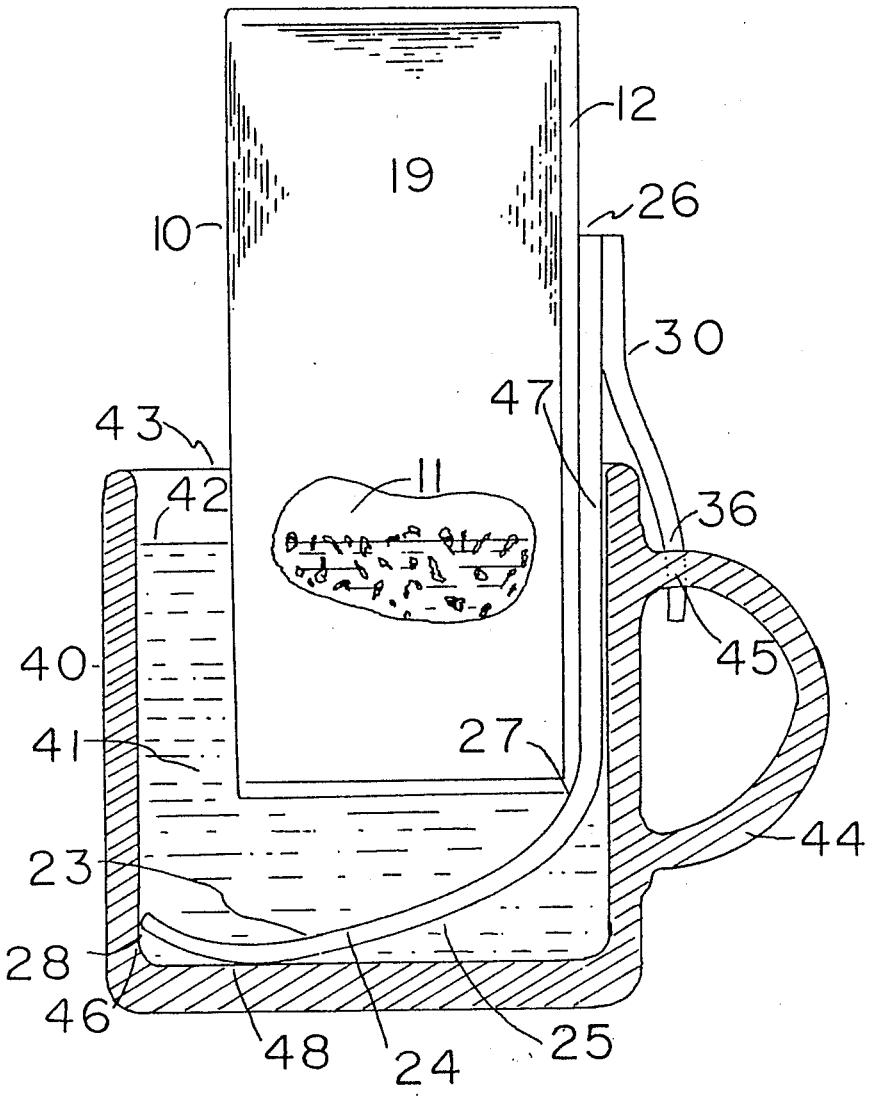
FIG. 2 illustrates a method of use wherein the disposable coffee brewing device is held inside a mug which contains water.

FIG. 2 illustrates a method of use wherein the disposable coffee brewing device of FIG. 1 is shown in use inside a coffee mug 40. FIG. 2 depicts a vertical cross sectional view of a coffee mug 40 into which has been inserted a disposable coffee brewing device depicted in FIG. 1. Drinking water 41 is subsequently added to fill to level 42 said level being somewhat lower then the rim 43 of mug 40. After the above two preparation steps are completed the ensemble is placed inside a microwave oven for a period sufficient to extract the coffee flavor.

Tab 30 passes over the mug rim and is positioned so that the mug handle 44 at region 45 passes inside cutout 36 of tab 30. Cutout 35 (FIG. 1) along with passage 37 facilitate the insertion of mug handle 44 into tab cutout 36. Concurrent with the engagement between tab 30 and mug handle 44, the support element 23 and attached filter bag 10 have been inserted inside the mug 40. Support element end 28 is in contact with the mug inner surface at 46. The extended free end of tab 23 is flexed so that surface 24 is concave upward, the obtuse surface 25 is in contact with the inner wall of the mug 40 as at 47 and the bottom of the mug as at 48. The length of tab 23 (discussed in FIG. 1) from terminus 27 to tab end 28 insures that upon insertion that region of the tab 23 will bend and exert a lateral force which pushes surface 25 against the inner wall 47. Engagement of tab 30 and mug handle 45 prevents the disposable brewing device from lifting vertically out of the mug 40. Filter bag 10 is anchored inside the mug by virtue of the spring action of support element 23 and the anchoring of cutout 36 around mug handle 44. Ground coffee beans 11 are immersed in liquid 41 and become wetted by the liquid. A significant inner volume 19 of filter bag 10 remains above the liquid surface 42. Vapors and gasses emanating during the brewing process accumulate and inflate the filter bag volume 19. Buoyant force due to these vapors is reduced by virtue of volume 19 being above the liquid surface. Filter bag 10 and contents 11 can oscillate back and forth about hinge 26 to 27 in response to convection currents that occur when the water is heated. Filter bag 10 is held vertically above the liquid by the height of hinge as at 26, this prevents the volume 19 from drooping over the mug rim 43 and spilling coffee outside the mug. The handling edges 39 described in FIG. 1, remain outside the liquid at all times. consequently , they do not experience a large increase in temperature, therefore upon removal from the microwave oven the disposable brewing device (FIG. 1) may be comfortably grasped and removed from the mug and discarded.

From the foregoing description, it will be appreciated that the resilient support element having the filter bag attached to its inner surface enables the support element to maintain the filter bag in a vertical alignment inside a mug containing water.

Another feature of the invention that a tab securely anchors this invention to the mug handle. This feature enables the disposable brewing device to be properly positioned during the unattended brewing process. Another feature of the invention large filter bag inner volume which remains above the liquid surface and restricts and contains the vapors and gases and prevents spillage.

What is claimed is:

1. A disposable brewing device for brewing coffee in a cup comprising: an elongated filter bag enclosing a measured amount of ground coffee beans sealed therein and a thin, elongated flexible filter bag support element secured to said filter bag over a portion of both the length to the filter bag and the length of the support element leaving an upper portion of the bag relative to its vertical orientation in said cup and a lower portion of the support element unattached to each other; the filter bag being secured to said support element along a longitudinal edge of said filter bag so that the bag is oriented relatively transversely from said support element relative to the transverse direction of the bag when said device is placed in said cup, the attachment between said bag and said support element is such as to allow said bag to move freely from side to side relative to said support element; said support element comprising a tab element which extends away from the support element and the bag and which includes a cut out region sized and configured to engage a handle of said cup when said device is place in said cup, said lower unattached portion of said support element having an inward bend in a direction away from the tab element; the length and configuration of the unattached lower portion of said support element being sufficient such that when said device is placed in said cup with said tab element extending outside the cup with its cut out region engaging a handle of said cup, said lower unattached portion of said support element is in contact with the inner surface of the lower portion of said cup and is flexed so that it is concave upward to provide a spring action which pushes the attached portion of the support element against the inner wall of the cup, which, in combination with the cut out portion, anchors said filter bag in said cup; said bag is dimensioned such that in its anchored position in said cup, said unattached upper portion of said bag as well as a portion of said attached portion of said bag remains above the upper rim of said cup.

* * * * *